United States Patent [19]

Konrad

[11] 4,206,711

[45] Jun. 10, 1980

[54] METHOD AND APPARATUS FOR PROCESSING WASTE FLUID

[75] Inventor: Kurt Konrad, Pittsburgh, Pa.

[73] Assignee: Angelo J. Noce, McMurray, Pa.

[21] Appl. No.: 948,393

[22] Filed: Oct. 4, 1978

[51] Int. Cl.[2] ..... F23G 7/04

[52] U.S. Cl. ..... 110/238; 110/346

[58] Field of Search ..... 110/235, 238, 346; 431/2, 8

[56] References Cited

U.S. PATENT DOCUMENTS

| | | | |
|---|---|---|---|
| 2,535,730 | 12/1950 | Gadret | 110/238 X |
| 3,295,478 | 1/1967 | Lowe | 110/238 |
| 3,738,289 | 6/1973 | Hanway | 110/238 |
| 3,822,653 | 7/1974 | Ghelfi | 110/238 |
| 3,828,700 | 8/1974 | Ragot | 110/238 |
| 3,921,543 | 11/1975 | Menigat et al. | 110/238 |
| 3,954,381 | 5/1976 | Marecaux | 110/238 X |
| 4,041,882 | 8/1977 | Dierckx | 110/238 |

*Primary Examiner*—Edward G. Favors

*Attorney, Agent, or Firm*—Carothers and Carothers

[57] ABSTRACT

The processing of combustible, partially combustible and non-combustible liquid waste at preferably high temperatures. The vertical combustion chamber is preferably round with liquids introduced from the top by spray nozzle or similar means and being treated as the liquid falls. Heat for preheating or processing comes from a number of flat flame radiation type burners addressing the falling liquid mostly by radiation heat. The number and arrangement of the auxiliary burners depends on the liquid to be processed and the furnace capacity. The auxiliary burner type and arrangement prevents flame impingement by the falling liquid. During the processing of certain liquids, the falling liquid will be totally surrounded by flames, from the top of the combustion chamber to a point at which no more processing is required. The discharge gases exit at the lower end of the combustion chamber and are beneficially utilized. For maximum efficiency, the liquid is air preferably air atomized. During processing of combustible liquids, the auxiliary burner fuel will be shut off while the combustion air of the auxiliary burners is left on providing combustible air for the waste liquid to be processed. Certain furnaces may be provided with a multiplicity of feed nozzles to provide means for simultaneous introduction of different types of liquids into the combustion chamber, such as combustible liquids through one nozzle, partially combustible liquid through another nozzle, and still other types of liquids through other feed nozzles.

25 Claims, 6 Drawing Figures

METHOD AND APPARATUS FOR PROCESSING WASTE FLUID

BACKGROUND OF THE INVENTION

1. Field of the Invention

The present invention relates generally to the high temperature processing of almost any waste liquid that can be pumped.

2. Discussion of the Prior Art

The disposal of waste liquids is an increasing problem for all industries producing waste liquids, as new laws prevent the practice of liquid disposal by land fill. Combustible liquids generated in one location must generally be hauled very long distances for incineration. The long distance transportation of combustible waste liquids is also presently being evaluated by appropriate authorities from a safety standpoint. As one example, a sizable approved waste liquid burning or incineration facility is not available within a 130 mile radius from Pittsburgh, Pa. The few large incineration facilities available in this country are usually rotary kilns which are very inefficient by design. Because of their inefficient combustion of waste liquids, they require large and expensive wet scrubbing dust collecting systems to meet current anti-pollution standards. These wet scrubbers produce their own problems by generating an effluent which has to be disposed of in some manner. This is the principle reason that large liquid incinerators are remotely located from populated areas. Also, being in remote areas, one cannot efficiently convert the generated heat into useful energy.

Other existing waste liquid incinerators are highly specialized devices generally used in small installations for specific liquid disposal. Technical limitations such as method of feeding of the liquid into the combustion chamber, uneven temperature in the combustion chamber, type of combustion chamber insulation, liquid contamination with particles, different combustion characteristics of the liquid to be processed, or sticking of the resulting ash to the combustion chamber walls are some reasons why liquid incinerators of the prior art are limited in their applications. In addition, liquid incinerators of the prior art, because of their technical limitations, are subject to explosions and to frequent damage due to explosions in the combustion chamber.

It is a principal object of the present invention to provide a method and apparatus for processing of waste liquids or fluids which are void of the stated hazards and disadvantages of the systems of the prior art.

SUMMARY OF THE INVENTION

The method and apparatus of the present invention for processing fluid or liquid refuse utilizes a vertical insulated combustion chamber having a top and a bottom. Radiant burner means are provided on the side walls of the combustion chamber within the furnace. This radiant burner means is capable of heating the combustion chamber with radiant heat to a temperaure sufficiently high to process fluid refuse to be sprayed within the chamber. One or more waste fluid spray nozzles are provided in the top of the combustion chamber to spray the liquid refuse downwardly in a predetermined pattern within the combustion chamber in such a manner that the spray does not contact the side walls of the chamber and does not impinge on the flame of the radiant burner means, such that the liquid spray is fully combusted by primarily radiant heat without flame impingement. Combustion air is continually supplied to the combustion chamber, and the resulting combustion gases are continually drawn off adjacent the bottom of the combustion chamber. Thus, a negative pressure is continually drawn in the chamber. As an energy conservation feature, the hot combustion gases which are continually drawn off are preferably directed through a boiler or heat exchanger in order to convert the high temperature of the exit gases, which are usually in excess of 2,000° F., from the combustion chamber into useful energy, such as for heating plant facilities.

Another preferable feature of the furnace of the present invention is the provision of insulation for the combustion chamber walls thereof by the use of a ceramic fiber felt insulation as opposed to the conventional type refractory which has a number of disadvantages in relation to ceramic fiber.

While any horizontal cross-sectional configuration of the combustion chamber may be utilized, a cylindrical combustion chamber is preferred, as it is believed that the radiant heat emanating from the side walls will be more uniformly distributed and will more uniformly process the falling liquid spray within the chamber.

The radiant burner means positioned in or on the side walls of the combustion chamber consist preferably of a plurality of flat flame radiant type burners disposed about the inner side walls of the combustion chamber. With some waste liquids, more radiant heat processing time or retention time will be required than that for other waste liquids while the liquid spray is in free-fall. In such situations, a plurality of levels of these flat flame radiant type burners are provided and disposed about the inner walls of the combustion chamber to consecutively address the falling liquid. In addition, these side wall burners provide a separation of flame or air between the inner side walls and the falling liquid spray pattern to further protect the insulation side walls from spray contact.

With these radiant type burners employed, combustion air is supplied to the combustion chamber through these side wall burners themselves. In fact, in situations where combustible liquid refuse is being processed, the side wall radiant burner means may be shut off after the combustion chamber has attained the appropriate heat and the fluid refuse spray has attained sustained combustion, and combustion air is continually supplied to the combustion chamber through these side wall burners after the fuel supply to the burners has been discontinued.

In further summary, the liquid processing furnace of the present invention is capable of treating combustible, partially combustible and non-combustible liquids at high temperatures. The number and arrangement of the burners will depend on the liquid to be processed and the furnace capacity. The burner type and arrangement prevents flame impingement by the falling liquids and during the processing of certain liquids, the falling liquid will be totally surrounded by flames, from the top of the combustion chamber to a point at which no more processing or combustion is required.

The liquid is introduced into the combustion chamber by one or more spray nozzles, and for maximum efficiency the liquid is air atomized at a suitable pressure and flow rate. The non-clog nozzles produce a predictable spray pattern at a specific diameter. The liquid spray occupies the center of the combustion chamber and corresponds with the desired optimum distance between the burner flame and the liquid. The liquid does not impinge on the burner flame. The number of spray nozzles feeding liquid into the combustion chamber will depend on the furnace capacity and types of liquids to be processed. In certain furnaces, the nozzles will feed different types of liquid simultaneously into the same combustion chamber. Thus, one nozzle may feed combustible liquid, another may feed non-combustible liquid, while still another nozzle may feed liquids with a high solid content.

As combustible, partially combustible and non-combustible and hazardous liquids are being processed, the burner quantity, function and arrangement may vary with each of these different type liquid.

For combustible liquids, the burner function is to preheat the combustion chamber. During normal processing of combustible liquids, the burners are turned off, but the primary air through the burners is maintained to supply primary air for the liquids to be processed and cooling air for the combustion chamber. The burners may also operate occasionally automatically should the temperature for any reason drop below a set level.

For partially combustible liquids, the burner function is to provide sufficient heat to evaporate moisture and combust the remaining liquid.

For non-combustible liquids, the burners are arranged to provide optimum radiant heat for the liquid to be processed. The burners may be arranged to form an almost uninterrupted wall of flame from the top of the combustion chamber to a point at which no more processing is required. Under these conditions, the burner flames also serve as separation media between the processed liquid and the combustion chamber insulation.

During processing of hazardous liquids, the burner quantity and arrangement may be the same as for non-combustible liquids.

In certain furnaces of the present invention, the flat flame burners may be used to supply waste liquid in place of fuel. Thus, during the processing of combustible liquids, it may be advantageous to start the furnace in the usual mannerr letting the burner preheat the combustion chamber and ignite the liquid to be processed and later manually or automatically convert some or all burners to supply a non-combustible waste liquid. With this arrangement, the combustible liquid fed through the upper center nozzles serves as means to provide processing heat for the non-combustible liquid flowing through the burners.

Depending on the liquid to be processed, a variety of auxiliary components can be attached to the furnace. As previously explained, for combustible liquids, the furnace is provided with a boiler or heat exchanger to convert the high temperature exit gases from the combustion chamber into useful energy. For hazardous liquids that require high temperatures and a long retention time before being combusted, the furnace is provided with a secondary chamber, which may be nothing more than a bottom lengthened extension of the normal combustion chamber, to lengthen the residence time of the gases at high temperature. For other liquids that contain uncombustible particles, the furnace is provided with dust collecting equipment. Any one or more of these auxiliary devices may be installed on each unit.

To optimize the use of the high exit temperature exiting from the furnace, the furnace may be provided with a variety of auxiliary systems such as a mechanism for the cleaning and sterilizing of 55 gallon steel drums, mechanism to process sludges, distilling equipment, or other devices that require heat.

The physical size of the furnace and the number of spray nozzles will depend upon the liquid capacity. The furnace can be built in small sizes of less than one gallon per minute capacity to larger capacities, such as 500 gallons per hour or larger.

Since, during normal operation, the liquid spray is never in contact with the furnace insulation, ceramic fiber insulation may be advantageously employed in place of conventional refractory as insulation for the combustion chamber. Ceramic fiber insulation can be rapidly heated and cooled eliminating the customary long preheating time required for refractory. No heat is required during shut-down periods. The ceramic fiber insulation weighs a fraction of what refractory weighs and costs less. Also, unlike a refractory lined furnace, the furnace of the present invention can be rapidly heated and cooled without damage to any part of the furnace. The use of ceramic fiber as insulation also makes the furnace very suitable for small and portable units where weight and frequent start-ups have to be considered. Ceramic fiber also saves on fuel costs since no preheating or maintaining of heat in the furnace is required.

For practical purposes, there are no temperature limitations on the furnace for fluid processing. However, normal operating temperatures for processing are generally in the range of 2,000° F.–2,400° F., but may be as high as 2,600° F. with a maximum temperature of 3,000° F. The liquid furnace of the present invention with high operating temperatures and long process retention time, and where required the additional use of dust collecting equipment, guarantees an environmentally clean and safe operation which will meet the most stringent anti-pollution laws.

By the use of a boiler or heat exchanger as previously explained, the liquid furnace of the present invention converts combustible waste liquids into useful energy, and the furnace thus becomes a burner which utilizes combustible waste liquids as fuel. Even with non-combustible waste liquids, the energy given off by the exit gases may be utilized. With combustible waste liquids, the auxiliary burners in the furnace serve to preheat the combustion chamber and to maintain a set temperature.

The present invention enables those skilled in the art to build large capacity waste liquid burners which will provide heat for industrial and commercial facilities. The present invention also makes it possible for those skilled in the art to build small burners for industries that want to convert their waste liquids directly into a heat source.

The furnace of the present invention is designed not only to prevent explosions, but should one occur, it is designed such that the combustion chamber and auxiliary equipment will not be damaged. The top of the furnace is provided with explosion relief means to relieve any explosions occuring in the combustion chamber and direct the explosion forces upwardly. This may be accomplished, for example, by providing weighted explosion doors in the top, or adjacent the top, of the furnace, or the furnace top itself may be floating or merely resting on the remainder of the furnace, such that it will lift to engage a stop to permit explosion pressures to escape.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENTS

Figure 1:
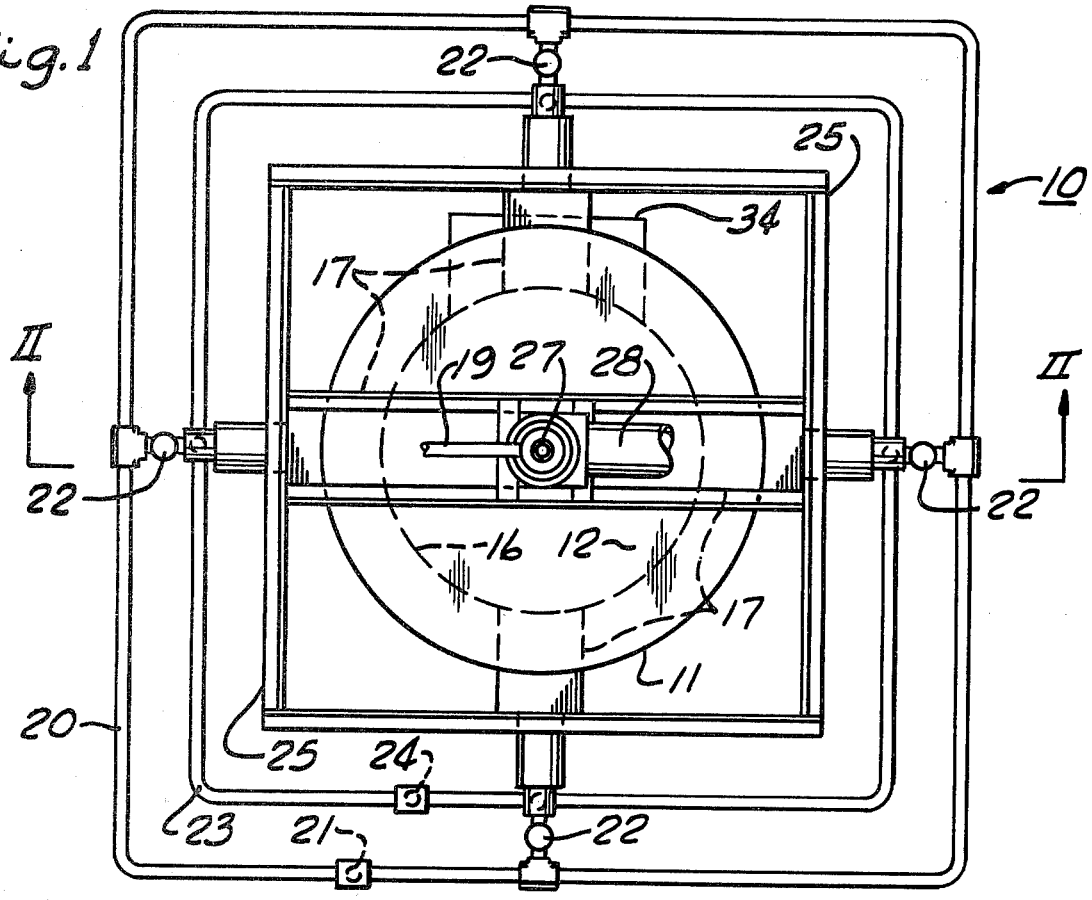
FIG. 1 is a plan view of one embodiment of the liquid refuse processing furnace of the present invention.
Figure 2:
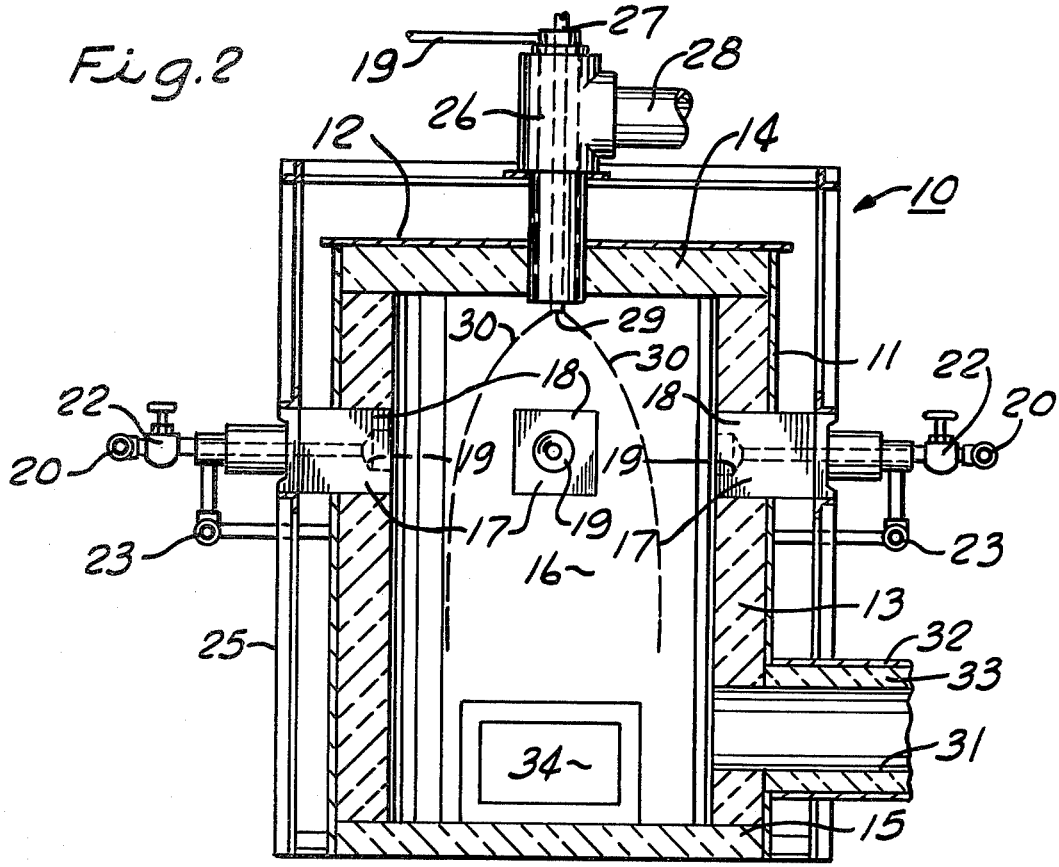
FIG. 2 is a sectional view in side elevation of the furnace shown in FIG. 1 as seen along section line II—II.

The processing furnace illustrated in FIGS. 1 and 2 generaly comprises a metal cylindrical furnace jacket 11 having a floating top 12. To prevent damage due to explosions, the entire inside of the furnace jacket 11 is lined with adequate insulation 13 on the inner cylindrical side wall, insulation 14 on top circular wall 12 and insulation 15 covering the bottom of the furnace. Insulation 13, 14 and 15 defines a vertical cylindrical combustion chamber 16 within the furnace 10. The insulation 13, 14 and 15 is any suitable insulation such as refractory insulation, and preferably a ceramic fiber felt insulation such as sold under the trademark FIBERFAX. The insulation should be capable of withstanding temperatures of up to approximately 3,000° F.

Radiant burner means in the form of four flat flame radiant type burners 17 are provided on the side walls of combustion chamber 16 and disposed equi-angularly thereabout to provide a uniform heat distribution. These flat flame radiant type burners 17 may be conventionally found on the market and are manufactured as, for example, by Hauck Manufacturing Company of Lebanon, Pa., or by North American Combustion Corporation. The characteristics of such burners are that they produce a flat flame and this radiant type burner actually heats it own refractory tile and the refractory surface of the surrounding furnace wall by convection from the high velocity combustion gases thrown sideways from the burners. The hot gases from the burners have no final velocity in the direction towards the center of combustion chamber 16 in order to provide as much true radiant heating as possible, or to prevent flame impingement of the liquid being treated, as will be hereinafter explained.

Each of the burners 17 has a nozzle outlet formed of refractory tile 18 with a flared or conical outlet port 19 to produce the flat flame which hugs the inner wall of the combustion chamber 16.

Fuel is supplied to the burners through fuel supply pipe 20 which surrounds the entire furnace 10 and feeds all four burners from main fuel supply pipe 21. A main fuel shut-off valve 22 is provided for each burner 17.

Burner primary combustion air is supplied to each of the four burners 17 through pipe 23, which in turn is supplied from primary air supply pipe 24.

Other types of radiant burners, such as electric, etc., may be substituted, but the type disclosed is preferred for the controllability, efficiency, and for the additional fact that combustion air may be supplied through the burners 17 even though the burner fuel supply has been shut off. Otherwise, separate combustion air supply facilities would have to be constructed.

For rigid support of the burners 17 and their supply pipes, a support structure 25 is provided. This support structure 25 as illustrated is formed from angle iron, but any suitable support material will suffice.

In addition, the support structure 25 also supports assembly 26 at the top which is the waste liquid, atomizing air and a primary combustion air input assembly. This assembly consists of waste liquid feed pipe 27, atomizing air feed pipe 19 and primary combustion air feed pipe 28. Atomizer tip or nozzle 29 is provided at the bottom of waste liquid feed pipe 27. The atomizing air being fed through pipe 19 from a compressor (not shown) is coaxially fed downward around pipe 27 and feeds into nozzle 29 to atomize the liquid spray which is sprayed downwardly from nozzle 29 as generally indicated by the dashed outline at 30. Atomizer nozzle 29 is a spray nozzle conventional in operation such as the type used for paint spray. The spray is atomized by the primary air supply in order to enhance combustion. Primary combustion air fed from pipe 27 exits directly into the top of the combustion chamber.

Nozzle 29 sprays the atomized waste liquid downwardly into combustion chamber 16 in a controlled or predetermined pattern, such as indicated at 30, such that the spray does not impinge on the side walls of chamber 16 and does not impinge on the flames of radiant heaters 17.

An exhaust port 31 is provided adjacent the bottom of combustion chamber 16 for continually drawing off combustion gases. Exhaust port 31 is formed by exhaust duct 32 with its internal insulation 33. The exhaust gases are continually drawn off as with a fan, thereby providing a continuous negative pressure within combustion chamber 16.

A furnace door 34 is also provided at the bottom of combustion chamber 16 for access into the interior of the bottom of the chamber in order to periodically clean the furnace bottom where incombustible particles will accumulate. The door also serves as an explosion door. Should an explosion occur inside the combustion chamber, the door opens relieving the pressure without damaging the interior of the chamber. Top 12 is also floating, or merely resting on the furnace jacket 11, such that when an explosion occurs, the top will raise until it hits the top support structure to relieve explosion pressures upwardly.

Figures 3, 4:
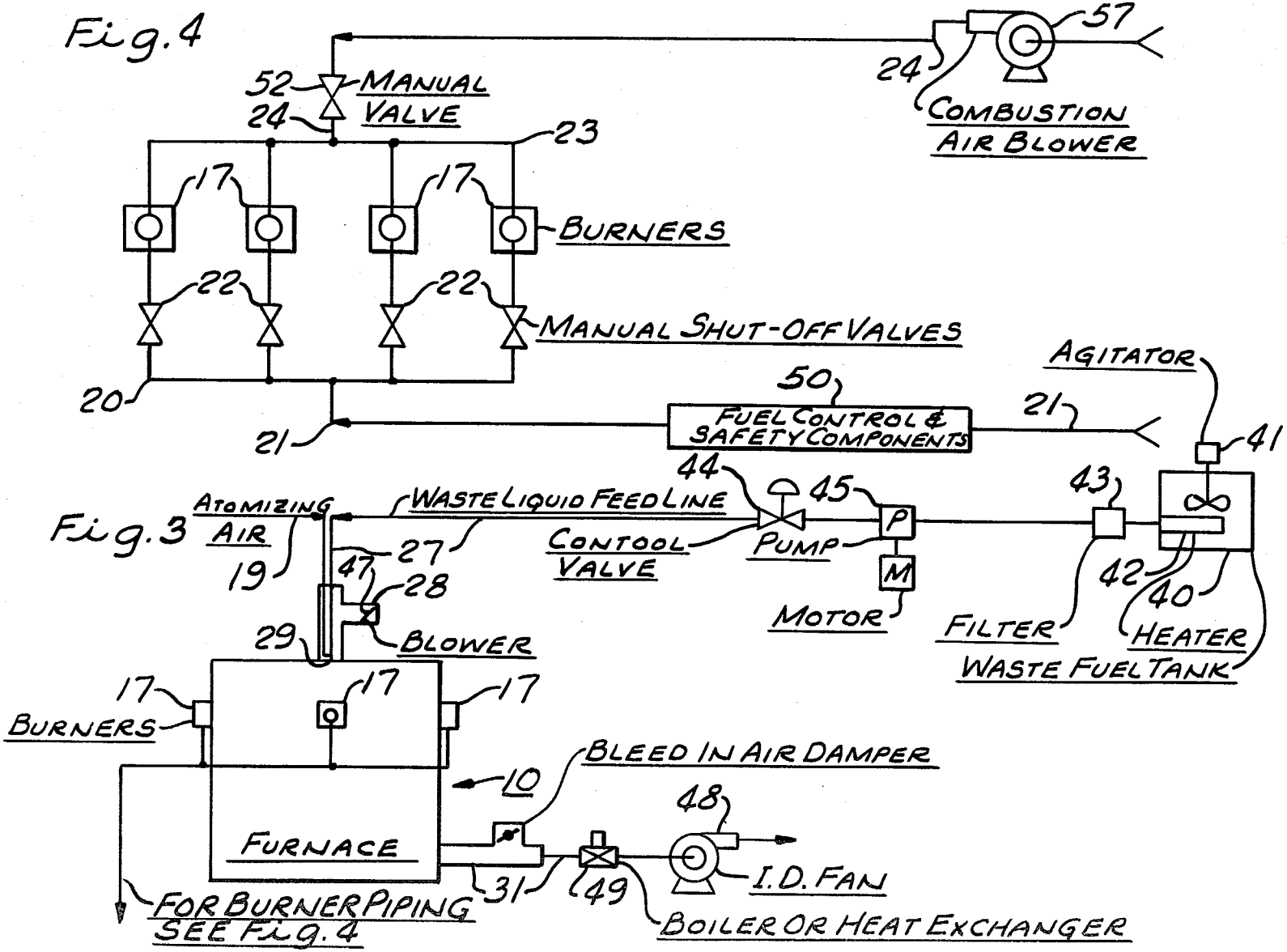
FIG. 3 is a simplified system flow diagram illustrating the operation of the method and apparatus of the present invention.
FIG. 4 is a simplified burner control schematic piping diagram illustrating the fuel and air supplies to the burners of the furnace illustrated in FIGS. 1, 2 and 3.

Turning next to the system flow diagram of FIG. 3, those elements from FIGS. 1 and 2 which are identical are given the same numeral designations. The waste liquid to be processed is stored in tank 40 and is preferably agitated by agitator 41 to keep the liquid thoroughly mixed.

An optional electric heater may be provided at the outlet of tank 40 to waste liquid feed line 27 in order to heat the liquid exiting the tank if required, in order to preheat for combustion or to make the liquid less viscous.

Filter 43 may also be provided optionally in feed line 27 in order to filter out large particles which could possibly clog spray nozzle 29. In addition, the flow within waste liquid feed line 27 is controlled by valve 44.

The waste liquid is pumped through line 27 from tank 40 by means of the pump-motor combination 45. Pump 45 may be variable speed in order to regulate the fluid pressure exiting nozzle 29.

The combustion air is drawn in through pipe 28 and the damper 47 by variable speed exhaust fan 48. Atomizing air is fed to nozzle 29 from an air compressor through pipe 19. Thus, by regulating the waste liquid feed pressure and the atomizing air pressure in line 19 and the atomizer nozzle 29 characteristics, the pattern and characteristics of the liquid spray can be easily regulated.

The combustion gases within furnace 10 are continually drawn off to provide a negative pressure within the combustion chamber of the furnace through outlet duct 31 by means of fan 48. Exhaust duct 31 is provided with a bleed-in air damper as indicated. Also, a boiler or other type heat exchanger 49 is provided in exhaust duct 31 in order to take beneficial advantage of the exhaust heat, such as for heating other plant facilities or for preheating either one of the air intakes into the furnace 10 itself.

The piping for air and fuel for burner 17 is illustrated in more detail in the schematic of FIG. 4. In this Figure, the fuel for burner 17 flows from a fuel source via line 21 into a conventional fuel control and safety component device 50 and then on through line 21 to pipe line 20 to the four flat flame burners via their shut-off valves 22.

The combustion air for burners 17 is supplied via line 24 from combustion air blower 51 and flows through a main valve shut-off 52 to each of the four burners 17.

For combustible liquids, the burners 17 function to preheat combustion chamber 16. Once the atomized spray 30 has attained sustained combustion and normal operating temperatures are maintained, burners 17 are shut off. However, primary air is still fed through the burners via line 24 to maintain the supply of primary combustion air for the liquid to be processed and to also supply cooling air for the combustion chamber. The rate of this air flow can be regulated by blower 51 or valve 52 or a combination thereof. Burners 17 may also be operated automatically through the use of thermostatic controls in order to re-ignite the burners if for any reason the temperature should drop below a predetermined value within the combustion chamber and as preset on a conventional thermostat control.

An example of some of the liquids which can be processed, and in fact have been processed by the inventor in a pilot facility for the present invention are paint solvents, reactor solvents (resin waste), waste oils from transformers, styrene waste, hexane waste, cyclohexane waste, water and oil mixtures (70% water, 30% oil in test examples), uncontaminated water, and assorted liquids from plastic manufacturing.

The capacity of the furnace varies with the liquid being processed. The average capacity for combustible liquids in a small pilot facility constructed similar to that illustrated in FIGS. 1 and 2, is 25 gallons per hour, and for non-combustible liquids, 120 to 180 gallons per hour. In these test runs, the combustion chamber size was only 36 inches in diameter and 93 inches high. The combustion chamber temperature was 2200° F., and the exit temperature was 2300° F., with a combustion chamber pressure of 1 inch water column negative. Complete combustion was obtained without the requirement of added pollution controls, yet environmental standards were easily met.

Figure 5:
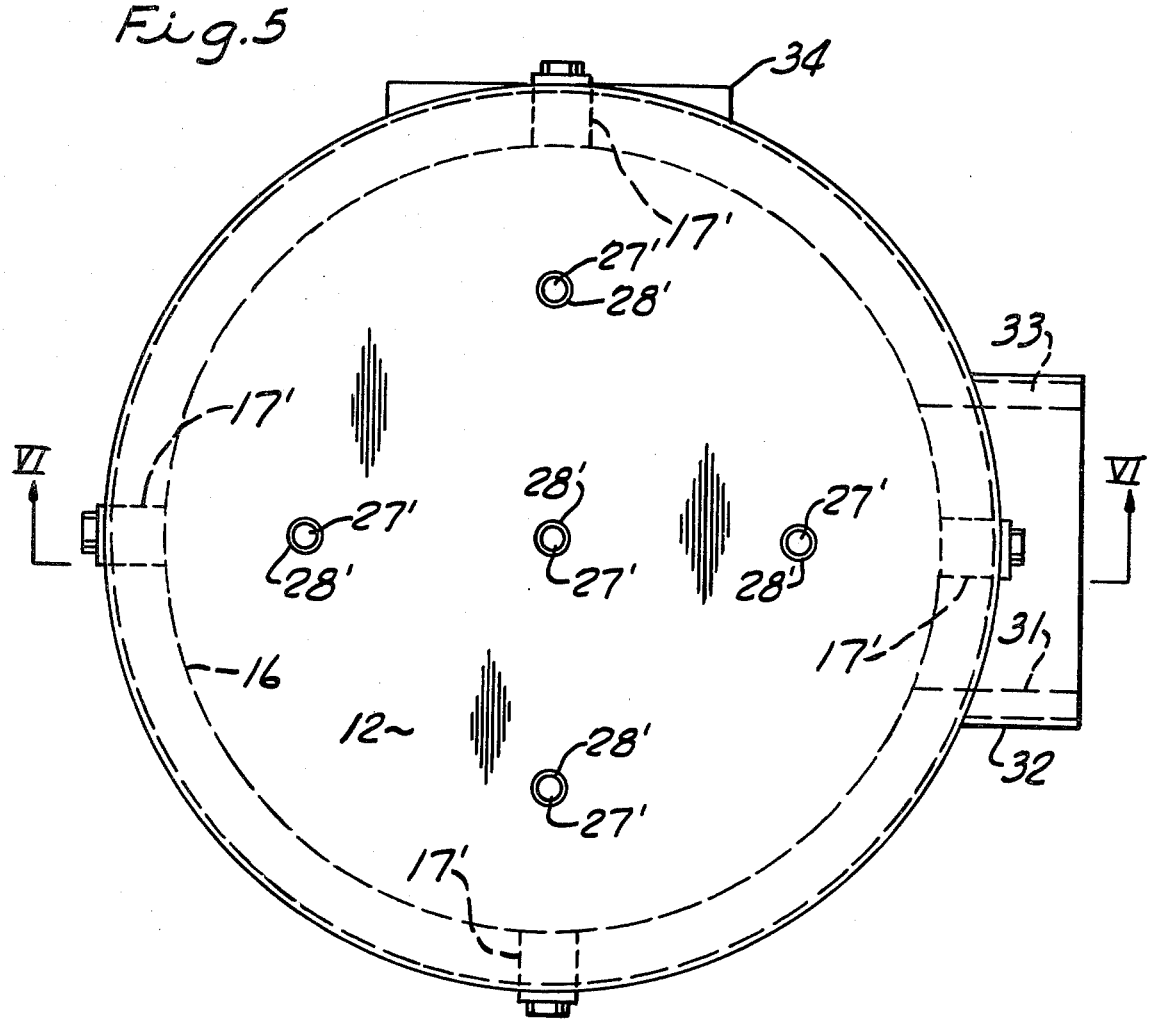
FIG. 5 is a partially diagrammatic plan view illustrating a variation of the liquid refuse furnace illustrated in FIGS. 1 and 2 for larger liquid processing capacity.
Figure 6:
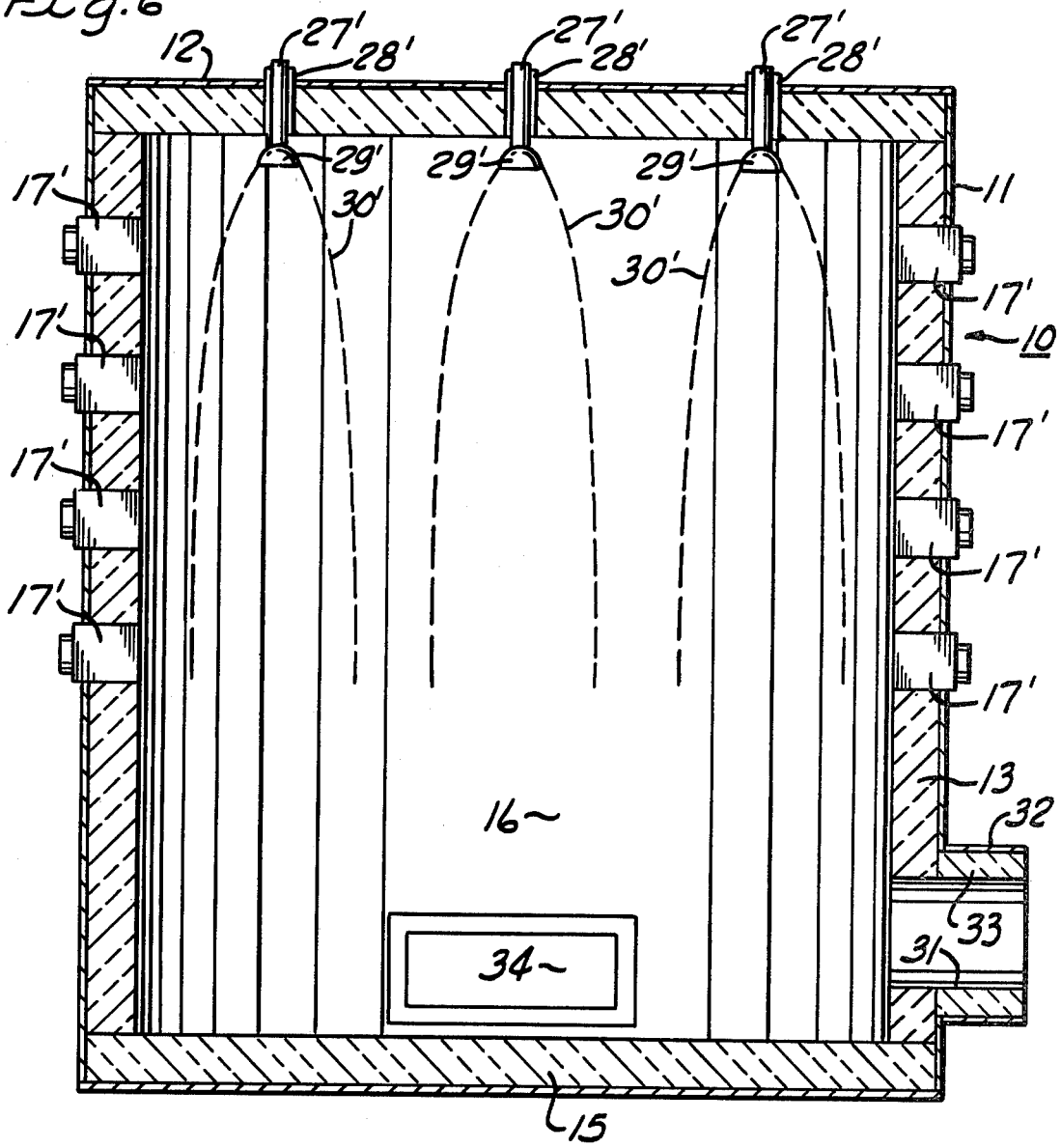
FIG. 6 is a partially diagrammatic view in side elevation section of the furnace illustrated in FIG. 5 as seen along section line VI—VI.

For larger capacities, a larger furnace may be constructed in accordance with the teachings of the present invention as illustrated in the block diagrams of FIGS. 5 and 6. In addition, additional levels of radiant burners and additional spray nozzles may be provided in the furnace. For example, when processing non-combustible liquids, it may take a longer free fall combustion zone within the furnace to obtain complete combustion of the liquid spray. The burners may thus be arranged to form an almost uninterrupted wall of flame from the top of the combustion chamber to a point below which no more processing is required. This can be accomplished by supplying more burners disposed about the furnace and additional layers or levels of burners within the combustion chamber. Under such conditions, it can also be seen that the burner flames or the air emanating therefrom help to serve as a separation media between the processed liquid and the combustion chamber insulation.

Turning particularly to FIGS. 5 and 6, these Figures illustrate the furnace of the present invention in a much larger capacity so that much larger quantities of waste liquids may be processed, and in addition a longer retention time capability for processing in the larger furnace is enhanced.

In FIGS. 5 and 6, like elements to those illustrated in FIGS. 1 and 2 are designated with the same numerals, and like elements which are provided in multiple are provided with the same numerals primed.

In the embodiment of FIGS. 5 and 6, four levels of radiant burners 17 are provided, and four burners are disposed about the furnace combustion chamber 16 for each level. This provides an almost un-interrupted wall of flame from the top of the combustion chamber 16 to a point below which no more processing is required. This is particularly effective for non-combustible liquids or liquids fed in large capacities to the furnace. In addition, the bottom of the combustion chamber 16 may be lengthened to provide additional retention time.

Instead of just one nozzle feeding the atomized liquid spray into the chamber, a multiplicity of nozzles are symmetrically arranged in the top of the furnace to enable one to feed different types of liquid simultaneously into the combustion chamber. With this arrangement, it is possible to feed non-combustible liquid through the center nozzle and one or more combustible liquids with different characteristics through other nozzles while feeding still another liquid that does not mix with the aforesaid liquids through yet another feed nozzle. This feed system optimizes the furnace's efficiency and improves the scope or capabilities of the unit.

Regarding operation of the furnace illustrated in FIGS. 5 and 6, it is entirely the same as that described in conjunction with FIGS. 1 through 4.

In addition, if at least some of the nozzles 29' are feeding combustible liquids as self combustion has been sustained, the fuel supply to some or all of the burners 17' may be shut off and a non-combustible or partially combustible liquid may then be fed through the burners, via their fuel supply lines, along with combustion air for processing by the heat given off by the burning combustible liquid waste.

The skilled artisan will change the variables of the furnace such as waste liquid pressure, atomizing pressure, burner fuel, burner combustion air pressure and exhaust draw within his ordinary skill, depending upon the liquid being processed of the many different types of liquid or fluid possible.

I claim:

1. A processing furnace for fluid refuse comprising:
(a) a vertical insulated combustion chamber including a top and a bottom;
(b) radiant burner means positioned on the sides of said chamber, capable of heating said chamber with radiant heat to a temperature sufficiently high to combust fluid refuse sprayed into said chamber;
(c) waste fluid spray means operable through said top of said chamber to spray said fluid downwardly in a predetermined spray pattern into said chamber, said spray pattern which prevents said spray from contacting the side walls of said chamber and which prevents said spray from contacting said burner means;
(d) combustion air supply means operable to supply combustion air to said chamber; and
(e) exhaust port means adjacent said bottom of said chamber operable to draw off combustion gases from within said chamber.

2. The processing furnace of claim 1 wherein the fluid refuse to be processed is a liquid and including atomizing air supply means in the top of said chamber for atomizing said fluid spray.

3. The processing furnace of claim 1 including fan means to continually draw a negative pressure in said chamber through said exhaust port.

4. The processing furnace of claim 3 including a heat exchanger in said exhaust port.

5. The processing furnace of claim 1 wherein the insulation for said chamber is a ceramic fiber felt insulation.

6. The processing furnace of claim 1 wherein said combustion chamber is cylindrical.

7. The processing furnace of claim 1 wherein said radiant heater means is a plurality of flat flame radiant type burners disposed about the inner side walls of said combustion chamber and said nozzle means is designed to provide said spray pattern which does not impinge on the flame of said burners.

8. The processing furnace of claim 7 including a plurality of levels of said flat flame radiant type burners disposed about said inner walls of said combustion chamber.

9. The processing furnace of claim 7 wherein said burners are operable upon such spray pattern to further prevent contact between said spray pattern, on the one hand, and said side walls and said burners on the other hand.

10. The processing furnace of claim 7 wherein said combustion air supply means includes an air supply to said burners.

11. The processing furnace of claim 1 wherein said waste fluid spray means comprises a plurality of spray nozzles, each of said spray nozzles being concurrently operable with each other of said spray nozzles, each of said spray nozzles being operable to spray a composition of said fluid different from the composition of said fluid being sprayed from at least one other of said nozzles.

12. The processing furnace of claim 1 including explosion relief means in said furnace to relieve explosion pressure in said chamber.

13. The processing furnace of claim 12 wherein said explosion relief means includes a floating top on said furnace.

14. A method of processing fluid refuse comprising the steps of, heating a vertical insulated combustion chamber from the inner side walls thereof with radiant burner means, feeding combustion air into said chamber, spraying fluid refuse downwardly from the top of the combustion chamber in a controlled pattern within said combustion chamber without contacting said inner side walls and said radiant burner means while the temperature within said chamber is sufficiently high to combust said fluid refuse while falling, and continually drawing off gases of combustion from said chamber adjacent the bottom thereof.

15. The method of processing fluid refuse as claimed in claim 14, wherein the step of heating from the inner side walls is carried out by a plurality of flat flame radiant type burners disposed about the inner side walls and the pattern of said spray is controlled not to impinge on the flames of said burners.

16. The method of processing fluid refuse as claimed in claim 15, wherein the step of feeding combustion air into said chamber is carried out through said side wall burners.

17. The method of processing fluid refuse as claimed in claim 14, wherein the fluid to be combusted is liquid and including the step of atomizing said fluid refuse spray.

18. The method of processing fluid refuse as claimed in claim 15, wherein the fluid refuse being combusted is combustible and including the step of shutting off the fuel supply to said radiant burner means while continuing to feed combustion air into said chamber through said side wall burners after the combustible fluid refuse spray has attained sustained combustion.

19. The method of processing fluid of claim 18 including the step of feeding a waste fluid through selected of said burners after shutting off the fuel supply to the same.

20. The method of processing fluid refuse as claimed in claim 14, including the step of surrounding the falling spray with radiant heat from said side wall radiant burner means for a sufficient depth to fully combust said spray.

21. The method of processing fluid refuse as claimed in claim 16, including the step of cushioning off said liquid spray from the inner side walls of said combustion chamber with combustion air or flame from said burners.

22. The method of processing fluid refuse as claimed in claim 14, including the step of insulating the inside walls of said chamber with ceramic fiber felt insulation.

23. The method of processing fluid refuse as claimed in claim 14, including the step of passing said gases of combustion through a heat exchanger and utilizing the heat exchanged therefrom.

24. The method of processing fluid refuse as claimed in claim 14, wherein said vertical chamber is formed cylindrically.

25. The method of processing fluid refuse as claimed in claim 14, wherein the step of spraying includes the step of independently spraying a plurality of different waste fluids through a plurality of different nozzles in the top of said chamber.

* * * * *